United States Patent [19]

Thorogood

[11] Patent Number: 4,576,121

[45] **Date of Patent: * Mar. 18, 1986**

[54] CONVECTIVE HEATER

[75] Inventor: Robert M. Thorogood, Macungie, Pa.

[73] Assignee: International Coal Refining Company, Allentown, Pa.

[ * ] Notice: The portion of the term of this patent subsequent to Dec. 27, 2000 has been disclaimed.

[21] Appl. No.: 540,232

[22] Filed: Jan. 27, 1984

[51] Int. Cl.[4] ..... F22D 1/00

[52] U.S. Cl. ..... 122/7 R; 122/6 A; 122/20 B; 165/110

[58] Field of Search ..... 122/7 R, 20 B, 6 A, 122/235 A, 208, 367 R, 18, 19, 138, 140 R, 140 A, 166 R, 166 A, 360 A; 165/110

[56] References Cited

U.S. PATENT DOCUMENTS

| | | | |
|---|---|---|---|
| 2,239,895 | 4/1941 | Kuhner | 122/7 R |
| 2,955,807 | 10/1960 | Rieley et al. | 165/110 |
| 3,406,664 | 10/1968 | Blaskowski | 122/7 R |
| 3,841,270 | 10/1974 | Sokolowski | 122/7 R |
| 3,842,904 | 10/1974 | Gardenier | 122/7 R |
| 4,143,817 | 3/1979 | Oliver | 122/20 B |
| 4,201,191 | 5/1980 | Zink et al. | 122/360 A |
| 4,325,328 | 4/1982 | Miszak | 122/6 A |

*Primary Examiner*—Henry C. Yuen

[57] ABSTRACT

A convective heater for heating fluids such as a coal slurry is constructed of a tube circuit arrangement which obtains an optimum temperature distribution to give a relatively constant slurry film temperature. The heater is constructed to divide the heating gas flow into two equal paths and the tube circuit for the slurry is arranged to provide a mixed flow configuration whereby the slurry passes through the two heating gas paths in successive co-current, counter-current and co-current flow relative to the heating gas flow. This arrangement permits the utilization of minimum surface area for a given maximum film temperature of the slurry consistent with the prevention of coke formation.

9 Claims, 14 Drawing Figures

FIG. 1
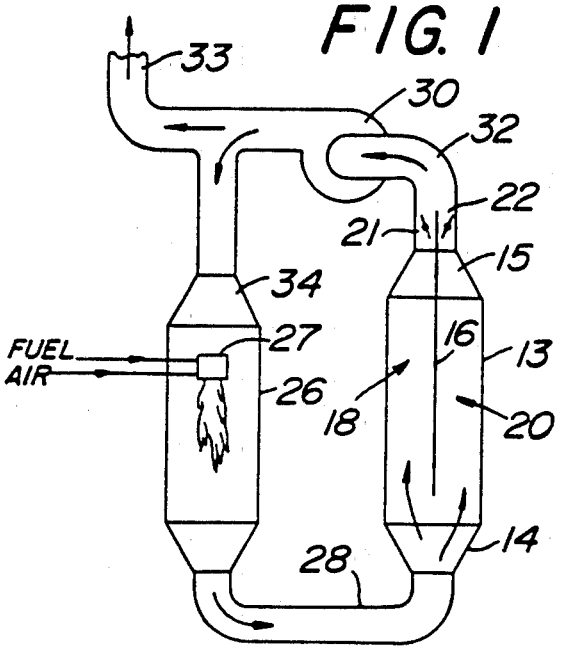
FIG. 4
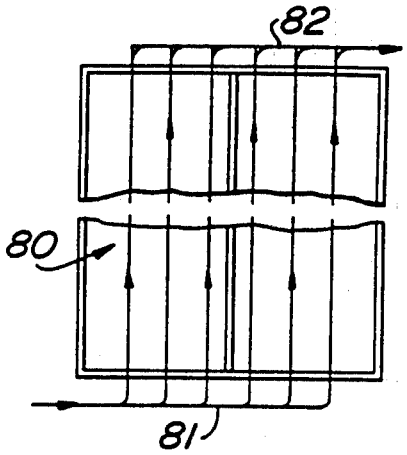
FIG. 6
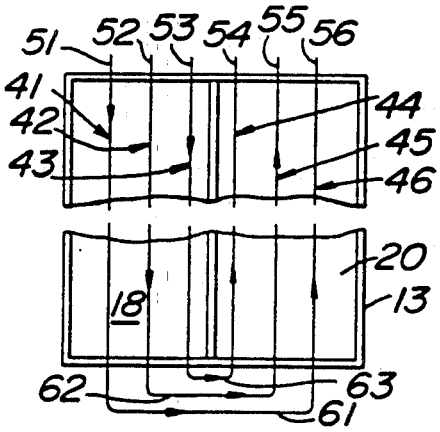
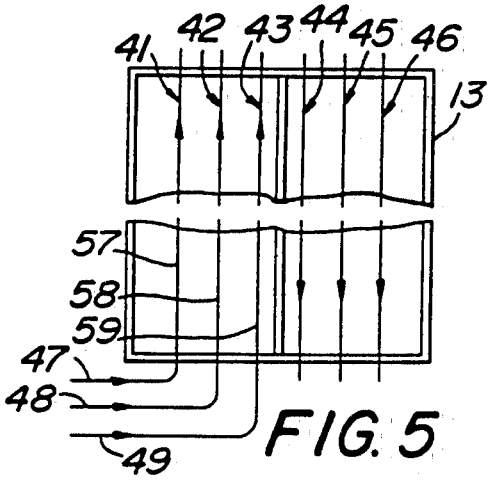
FIG. 5
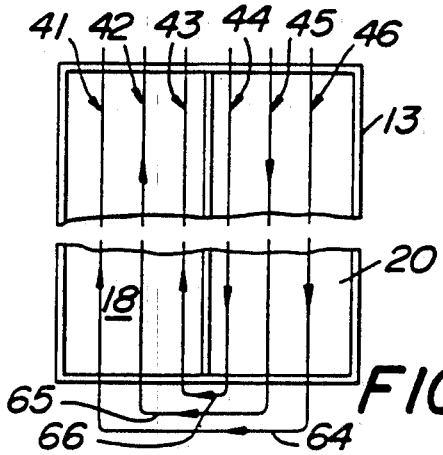
FIG. 8
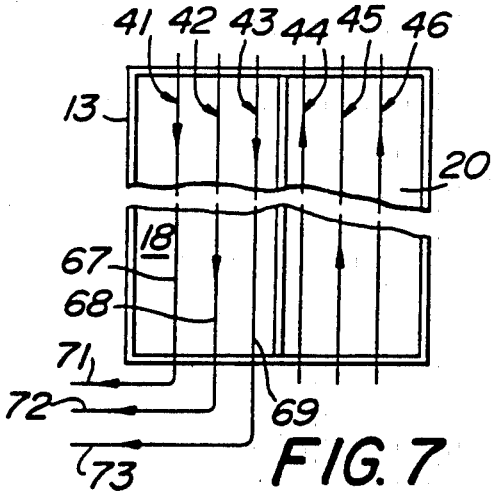
FIG. 7

CONVECTIVE HEATER

BACKGROUND AND SUMMARY OF THE INVENTION

In the conversion of coal to synthetic fuels by direct liquefaction, the coal is mixed with a recycle solvent and is hydrogenated in a three phase reactor at temperatures in the range 750° to 880° F. and pressures in the range 1000 to 3000 psi. The process is generally known as SRC-I, solvent refined coal having the acronym SRC. In this and similar processes, coal is mixed with solvent at low temperature (typically from 150° to 450° F.) and atmosphere pressure. The resulting slurry is pumped to a high pressure (for example, 2500 psi) and is then preheated in heat exchangers to a temperature of approximately 500° F. This temperature is chosen to be sufficiently low that dissolution and reaction of the coal has not commenced.

Hydrogen gas is then added to form a three phase mixture which is heated in a fired heater, prior to entry to the reactor vessel. This fired heater is a critical component in the direct liquefaction of coal. Because of the high operating pressure and temperature and the erosive corrosive nature of the coal slurry, expensive materials are required for the fired heater tubes making this unit a major cost item in the liquefaction process.

Further, reaction of the coal system commences in the fired heater, and coke formation from the coal products may occur at any location where very high temperatures are encountered, for example, at the surface of the heated tube wall. The avoidance of coke formation is an important consideration in the design since coke buildup will eventually cause tube plugging and may, in an extreme case, lead to tube wall temperatures sufficiently high to allow rupture of the tube.

A primary objective of this present invention is to optimize the tube wall temperature throughout the heater such that coking is minimized while utilizing the least possible surface in order to minimize the cost.

Problems which must be addressed in the design of a fired heater for coal slurry service are:

1. Swelling and dissolution of coal in solvent as it passes through the temperature zone from 500° to 650° F. lead to a large peak in the magnitude of the coal slurry viscosity. This region of high viscosity, termed the "gel region", has a low heat transfer coefficient. Immediately following this inlet and intermediate temperature region in the heater, the heat transfer coefficient increases rapidly. This variation of heat transfer must be accomodated in the design of the heater while avoiding the possibility of coke formation.
2. The flow of a slurry is preferably handled in a horizontal tube configuration. This prevents the possibility of flow blockage by settling which may occur in vertical tubes.
3. Tube erosion by the slurry must be avoided by limiting flow velocities and avoiding short radius tube bends.

A design of a fired heater which recognizies the latter two problems has been described in U.S. Pat. No. 4,013,402. In this patent, there is disclosed a radiant heater having a tube configuration containing the slurry flow in a horizontal racetrack arrangement with long radius return bends. This arrangement is not entirely satisfactory since it may cause unacceptable high tube wall temperatures in the inlet temperature range from 500° to 650° F. The heater configuration generates a maximum heat flux at the inlet area of the slurry tube circuit where the inside heat transfer coefficient is low. This could lead to high slurry film temperatures and coking in the coal gel formation zone of the heater.

Thus, this prior art design does not allow for variations of tube side heat transfer coefficients. Substantial variations in such heat transfer coefficients are probable in the heating of a coal slurry of the indicated type due to the effect of viscosity changes of the slurry during solvent absorption by the coal and the dissolution process. Hence, if the heat flux in the heater is maintained low to avoid the likelihood of coke formation, then the upper zones of the heater may require an unnecessarily large surface area.

As an alternative to the radiant fired heater, convective designs are known which have the advantage of obtaining more uniform heat transfer to the tubes and are not subject to the occurrence of local hot zones in the furnace due to such problems as flame impingement. In such a convective heater, hot discharge gases from a burner or burners are mixed with recirculated cooler gases. The gas mixture is passed over the outside of the tube bank in which the coal slurry is heated. The cooled exit gases are then divided into two streams, one part of the gas is exhausted to atmosphere, the second part provides the recirculated gases to mix with the burner discharge gases. In the tube bank, several circuits are arranged in parallel with the pipes transverse to the flue gas flow. The coal slurry flowing in the pipes has a flow configuration either cocurrent with or countercurrent to the flow gases.

In this type of prior heater, in order to obtain uniform flow of the flue gases, it is usually necessary to have several pipe circuits in parallel. This, in combination with other economic considerations which require minimization of the number of pump and pipe coal slurry flow circuits, determines that such heaters are primarily suitable for very large duties--for example, only one heater may be required for a 6000 T/Day coal liquefaction plant. This may be considered a disadvantage since the plant onstream capability may be adversely affected by an individual circuit failure.

The co- or countercurrent flow arrangement is most efficient when the heat transfer coefficient for the process fluid only exhibits small variations throughout the heater. Then, by the use of varying tube spacing and added external surface (fins) it is possible to optimize the heat flux distribution. When the process fluid heat transfer varies widely, as for a coal slurry, such an optimization is not practical and the heater must generally be designed for the lowest prevailing heat flux.

The heater construction in accordance with the invention is designed to obviate the above-discussed problems of the prior art heaters. To this end, heat flux variations on the fired side are minimized by utilizing a convective design. In addition, the fired side temperature profile is selected to minimize the possibility of the slurry film temperature exceeding the coking temperature. Moreover, the relative heat inputs to zones of the furnace are controllable. Furthermore, the design in accordance with the invention permits the use of two 50% duty units without a large cost premium when compared with a single 100% unit.

Briefly stated, the convective heater in accordance with the invention is constructed so that the flue gas flow is divided into two parallel paths across the slurry tube circuits. Three parallel slurry tube circuits are used and are arranged so that each tube circuit enters the heater at a central point in one path of the flue gas circuit and flows co-current to the flue gas exit. The tube circuit then crosses to the other flue gas path and flows counter-current to a location near its inlet. The tube circuit then returns to the first flue gas path and flows co-current to leave the heater adjacent to the entry location.

The advantages of the mixed flow arrangement of the invention are as follows:

1. Less surface is required;
2. Lower and more uniform maximum film temperatures are possible;
3. A 2×50% duty arrangement can be utilized with a minimum increase in cost.

In accordance with another feature of the invention there is provided a special cross-over arrangement of the return bends for the tube circuits to provide a compact tube arrangement while retaining a long radius for the return bends. This also provides a more uniform temperature relationship between the three tube circuits by interchange of the heat transfer contact between the coal slurry and different zones of the flue gas as the process flows progress through the heater.

Prior art heater constructions acknowledged herein are those disclosed in U.S. Pat. Nos. 1,833,130; 2,514,084; 2,669,099; 2,955,807; 3,258,204; 3,623,549; 4,201,191; and 4,230,177. These patents do not disclose the heater design of the present invention wherein the heating gas flow of a convective heater is divided into two flow passes with the tube circuit comprising a mixed co-current, counter-current arrangement.

BRIEF DESCRIPTION OF THE DRAWINGS

FIG. 1 is a schematic view of a convective heater system in accordance with the invention;

FIG. 4 is a section on line 4—4 of FIG. 2 in schematic form;

FIG. 5 is a section on line 5—5 of FIG. 2 in schematic form;

FIG. 6 is a section on line 6—6 of FIG. 2 in schematic form;

FIG. 7 is a section on line 7—7 of FIG. 2 in schematic form;

FIG. 8 is a section on line 8—8 of FIG. 2 in schematic form;

DETAILED DESCRIPTION OF THE PREFERRED EMBODIMENTS

Figure 2:
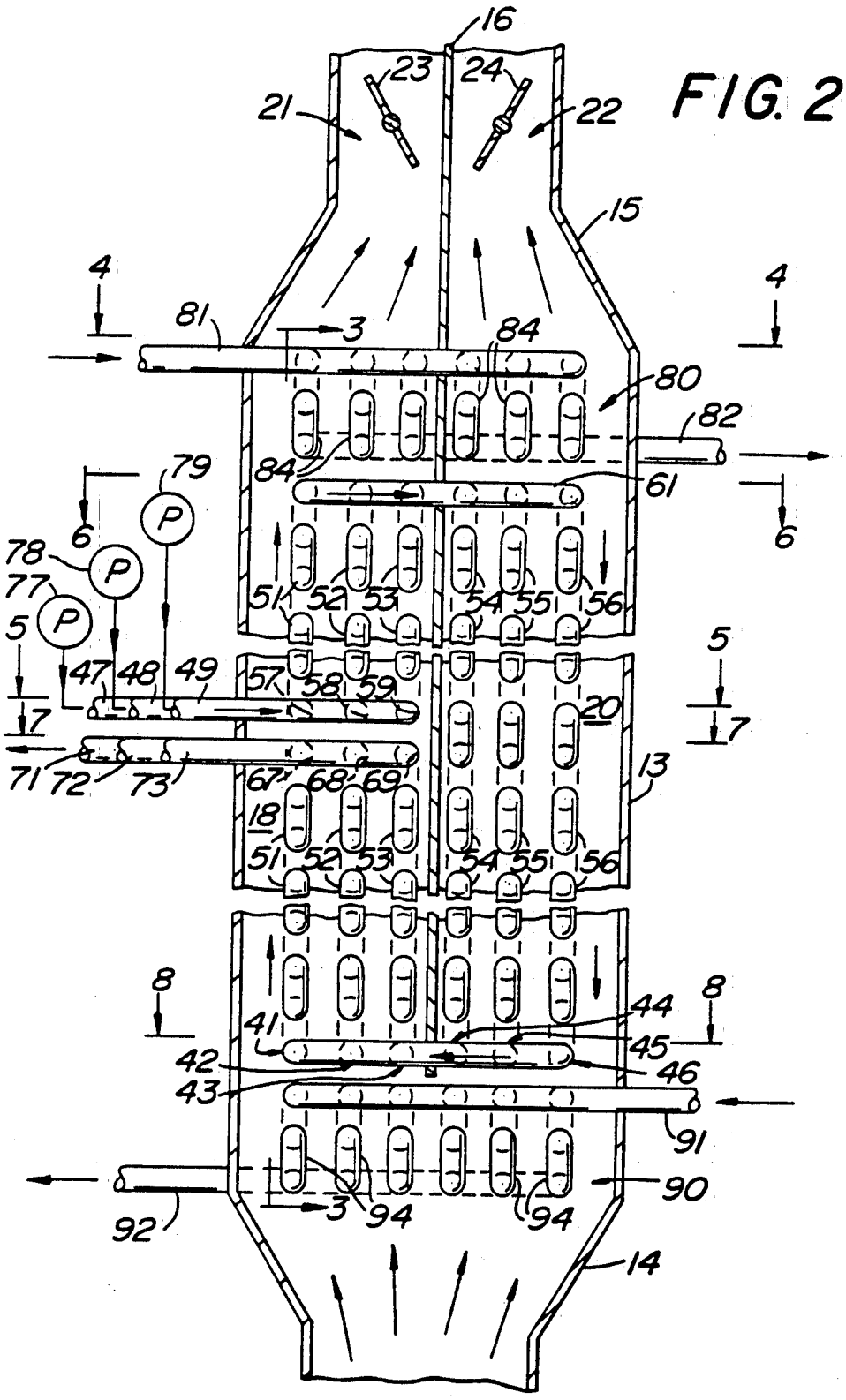
FIG. 2 is a side elevation of a convective heater in accordance with the invention, with parts broken away for illustrative purposes.

The convective heater in accordance with the invention comprises a casing 13, which is rectangular in cross-section and is constructed with a tapered inlet 14 and a tapered outlet 15. A dividing wall 16 within casing 13 divides the heating chamber between inlet 14 and outlet 15 into two equal paths 18 and 20 for the flow of heating gases. Dividing wall 16 extends into outlet 15 to provide two outlet passages 21 and 22, which are provided with balance dampers 23 and 24, respectively.

As shown in FIG. 1, hot flue gases from the burner section 26 of the heater are delivered to inlet 14 by way of conduit 28. Burner section 26 is provided with a suitable burner 27 supplied with fuel and air for combustion as shown in FIG. 1. A blower 30 has its suction connected to outlet passages 21 and 22 by conduit 32 and has its discharge divided, one part being exhausted to the heater stack 33 and the other part flowing to the inlet end 34 of heater section 26 as shown in FIG. 1. The general arrangement shown in FIG. 1 for circulating flue gases is conventional. In accordance with the inventive design, the hot flue gases from burner section 26 flow upwardly through inlet 14 and divide into two heating gas flows that flow through paths 18 and 20 and outlet passages 21 and 22 under the regulation of balance dampers 23 and 24, which adjust the relative flow between paths 18 and 20. This permits alteration to the flue gas temperature profile and heat transfer coefficient for compensation of variations in the coal slurry heat transfer.

Conduit means are provided for the flow of process fluid to be heated, i.e., the coal slurry, through heating (flue) gas paths 18 and 20 in heat exchange relationship with the hot flue gas passing from inlet 14 to outlet 15. In accordance with the invention, such conduit means is constructed and arranged to provide a mixed-flow tube circuit in which the process fluid enters one of the flue gas paths 18 at a location between inlet 14 and outlet 15 to flow in a co-current direction with the flue gases flowing through this one path 18 to a location near outlet 15 whereat the tube circuit transfers to the other flue gas path 20 to then flow in a counter-current direction relative to the flue gas flow through this other path 20 to a location near inlet 14 whereat the tube circuit transfers back to the first path 18 to flow in a co-current direction to the entry location whereat the tube circuit leaves said one path 18.

Figure 3:
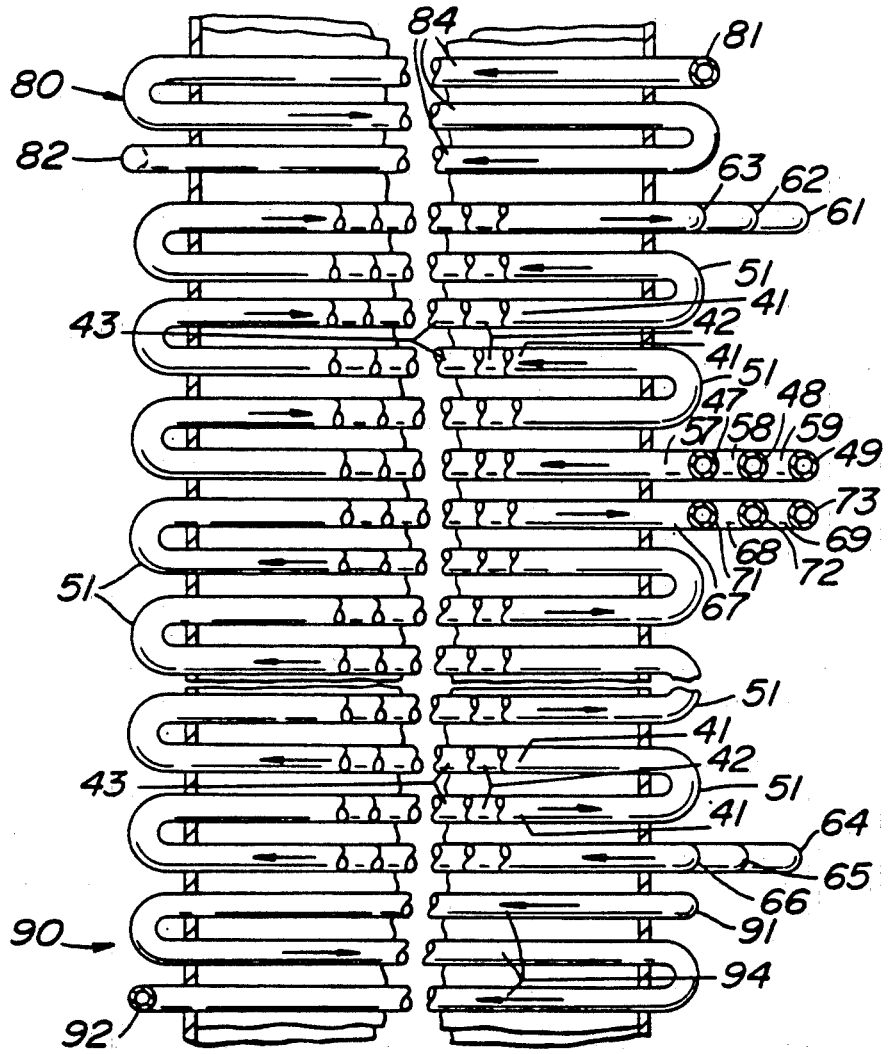
FIG. 3 is a section on line 3—3 of FIG. 2.

To this end, there are provided three parallel mixed-flow tube circuits, each of which comprises tubes arranged in a serpentine-like arrangement passing back and forth transversely through the heating chamber with return bends located externally of casing 13. More particularly, there are provided three vertical stacks 41, 42 and 43 of transversely and horizontally extending tubes located in flue gas path 18 and three vertical stacks 44, 45 and 46 of transversely and horizontally extending tubes located in flue gas path 20. A plurality of return bends 51–56 are provided to interconnect adjacent transverse tubes of stacks 41–46, respectively. Return bends 51–56 are arranged to provide the above-described mixed-flow arrangement in cooperation with crossover tubes to be described hereafter. As is best shown in FIGS. 3, 5 and 7 the return bends 51–56 are provided externally of casing 13.

The slurry is delivered into flue gas path 18 through supply pipes 47, 48 and 49 which are connected to inlet transverse tubes 57, 58 and 59, respectively, of tube stacks 41, 42 and 43 as shown in FIG. 5. Inlet transverse tubes 57, 58 and 59 are located at a selected intermediate location in the vertical extent of the tube stacks 41, 42 and 43 pursuant to the design characteristics of the convective heater.

Referring to FIG. 6, the top transverse tubes of stacks 41–46 are interconnected by crossover tubes 61, 62 and 63. Crossover tube 61 interconnects the top transverse tubes of tube stacks 41 and 46, crossover tube 62 interconnects the top transverse tubes of tube stacks 42 and 45, and crossover tube 63 interconnects the top transverse tubes of tube stacks 43 and 44. By this arrangement, crossover tubes 61, 62 and 63 provide for the transfer flow of slurry from flue gas path 18 to flue gas path 20.

Referring to FIG. 8, the bottom transverse tubes of stacks 41–46 are interconnected by crossover tubes 64, 65 and 66. Crossover tube 64 interconnects the bottom transverse tubes of tube stacks 41 and 46, crossover tube 65 interconnects the bottom transverse tubes of tube stacks 42 and 45, and crossover tube 66 interconnects the bottom transverse tube of tube stacks 43 and 44. By this arrangement, crossover tubes 64, 65 and 66 provide for the transfer flow of slurry from flue gas path 20 to flue gas path 18.

Referring to FIG. 7, the slurry is discharged from flue gas path 18 through discharge pipes 71, 72 and 73 which are connected to outlet transverse tubes 67, 68 and 69, respectively, of tube stacks 41, 42 and 43. Outlet transverse tubes 67, 68 and 69 are located immediately below inlet transverse tubes 57, 58 and 59, respectively.

The slurry is caused to flow through the three parallel tube circuits described above by means of pumps 77, 78 and 79 connected to supply pipes 47, 48 and 49, respectively, as is shown in FIG. 2.

It will be apparent that the above-described parallel tube circuits will convey the slurry through flue gas paths 18 and 20 in a mixed-flow sequence as shown by the arrows in the Drawings. Thus, the slurry will enter flue gas path 18 at a medial location between inlet 14 and outlet 15 by way of pipes 47, 48 and 49 and inlet tubes 57, 58 and 59 and flow in a co-current direction in serpentine paths through tube stacks 41, 42 and 43 to the top transverse tubes thereof near outlet 15. The tube circuits then transfer the slurry to flue gas path 20 by way of crossover tubes 61, 62 and 63 and the slurry flows in a counter-current direction in serpentine paths through tube stacks 44, 45 and 46 to the bottom transverse tubes thereof at a location near inlet 14. The tube circuits then transfer the slurry back to the flue gas path 18 by way of crossover tubes 64, 65 and 66 and the slurry flows in a co-current direction to outlet transverse tubes 67, 68 and 69 near the slurry entrance location. The slurry then leaves flue gas path 18 by way of discharge pipes 71, 72 and 73.

Referring to FIGS. 2, 3 and 4, the region of the heating chamber immediately below outlet 15 is provided with a tube circuit 80 for the passage of hot oil or steam through the heating chamber in heat exchange relationship with the flue gases passing through this outlet region. Tube circuit 80 comprises an inlet pipe 81, and outlet pipe 82 and six serpentine tube circuit portions 84 arranged in parallel relation extending between pipes 81 and 82 as is shown in the Drawings.

In addition, the region of the heating chamber immediately above inlet 14 is provided with a tube circuit 90 similar to tube circuit 80. Tube circuit 90 is provided for the passage of hot oil or steam through the heating chamber in heat exchange relationship with the flue gases passing through this inlet region and comprises an inlet pipe 91, and outlet pipe 92 and six serpentine tube circuit portions 94 extending between pipes 91 and 92 in parallel relation as is shown in the Drawings.

The tube circuits 80 and 90 serve to control the temperature of the flue gases at the inlet and outlet regions of casing 16. Tube circuit 80 serves to mix and eliminate hot zones in the flue gas prior to entry into paths 18 and 20. Tube circuit 90 reduces the temperature of the flue gas to a temperature acceptable for low cost construction of the flue gas circulating blower 30. In use, tube circuits 80 and 90 will contain steam or hot oil circuits used for utilities requirements in the coal liquefaction process.

Figure 11:
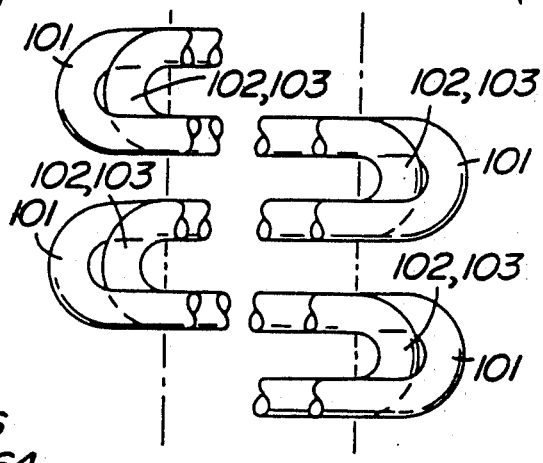
FIG. 11 is a view taken on line 11—11 of FIG. 10.
Figure 10:
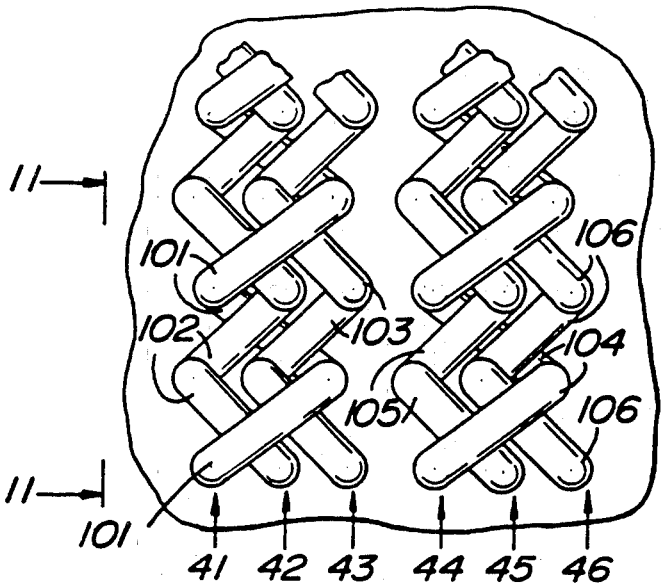
FIG. 10 is a fragmentary view illustrating an alternate return bend construction.

In FIGS. 10 and 11 there is shown a modified construction for the return bends extending between the transverse tubes of tube stacks 41–46. In this modified construction, the return bends cross back and forth between stacks 41–46 so that each tube circuit comprises portions of at least two of the tube stacks 41–43 and at least two of the tube stacks 44–46. More specifically, there is provided a group of return bends 101 extending between the transverse tubes in tube stacks 41 and 43, a group of return bends 102 extending between the transverse tubes in tube stacks 42 and 41, a group of return bends 103 extending between transverse tubes in tube stacks 43 and 42, a group of return bends 104 extending between transverse tubes in tube stacks 44 and 46, a group of return bends 105 extending between transverse tubes in tube stacks 45 and 44, and a group of return bends 106 extending between transverse tubes of tube stacks 46 and 45. The construction and arrangement of return bends 101–106 is illustrated in FIGS. 10 and 11.

Figure 9:
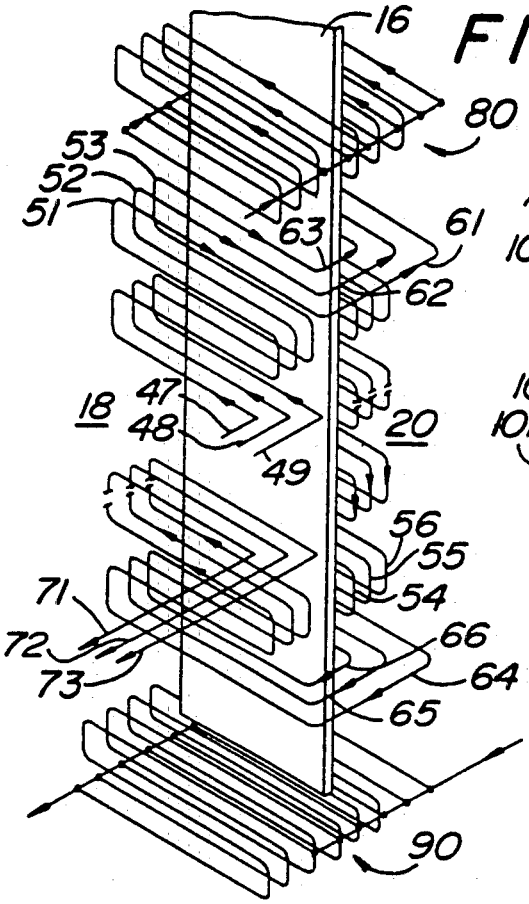
FIG. 9 is a schematic illustration of the tube circuits in the convective heater shown in FIGS. 2–8.

The advantages of the return bend construction shown in FIGS. 9 and 10 are that (1) the transverse tubes of a tube stack can be placed closer together for a given radius of return bend and (2) the effect of temperature variations of the flue gases throughout the transverse extent of the heating chamber can be minimized and applied more evenly to the slurry flowing through the tube circuits.

Figure 12:
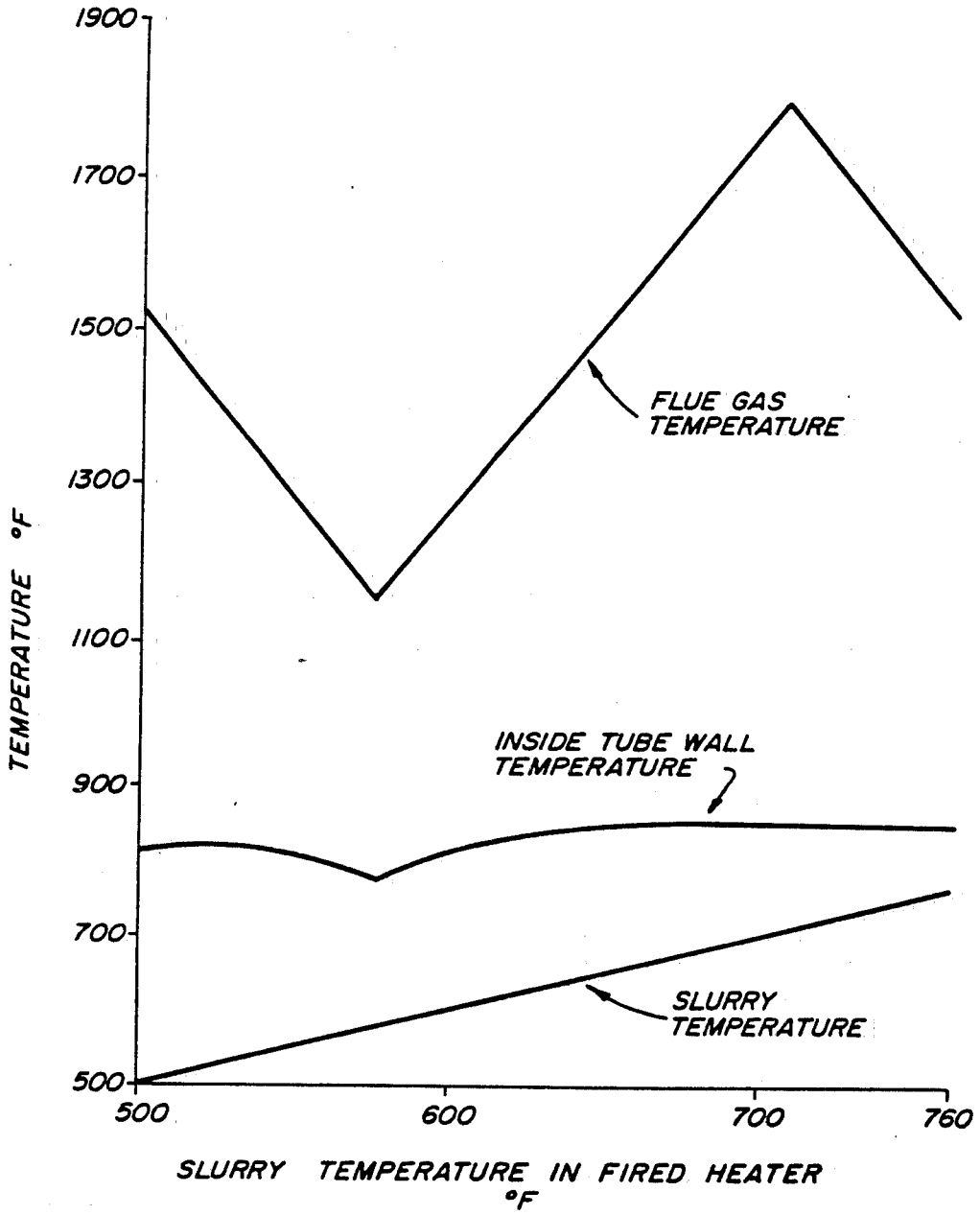
FIG. 12 is a graph showing the temperature profiles in a convective heater for a coal slurry in accordance with the invention.
Figure 13:
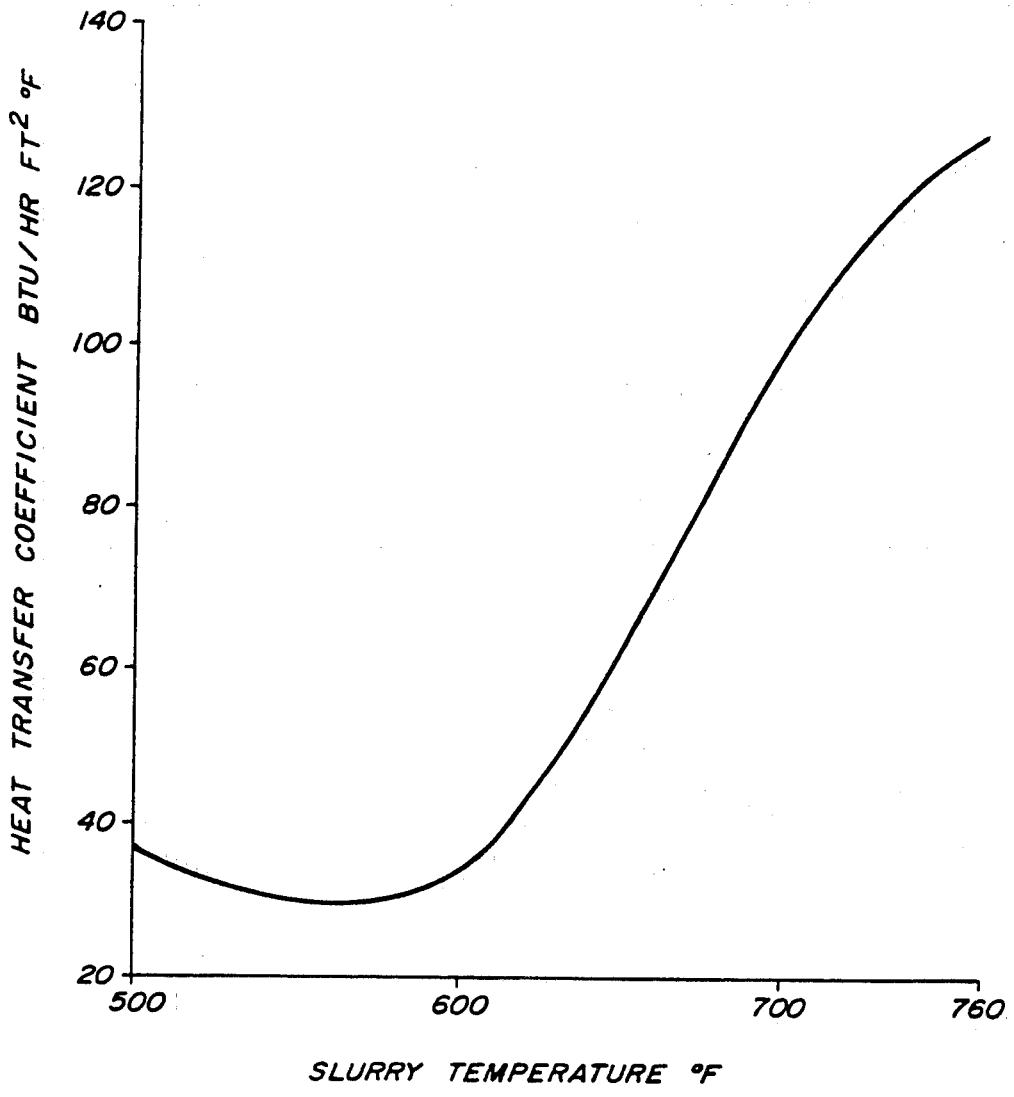
FIG. 13 is a graph showing typical heat transfer coefficients for an SRC-I coal slurry/hydrogen flow in an eight inch diameter pipe.

An example of the temperature profiles which may be obtained in a heater configuration in accordance with the invention is shown in FIG. 12. The heat transfer coefficient between the flue gases and the tube wall is assumed to be constant for this calculation of the tube wall temperature. The coal slurry heat transfer coefficient varies as a function of slurry temperature in the manner shown in FIG. 13. The values shown are typical for flow of coal slurry plus hydrogen in an eight inch diameter pipe at SRC-I process conditions.

Figure 14:
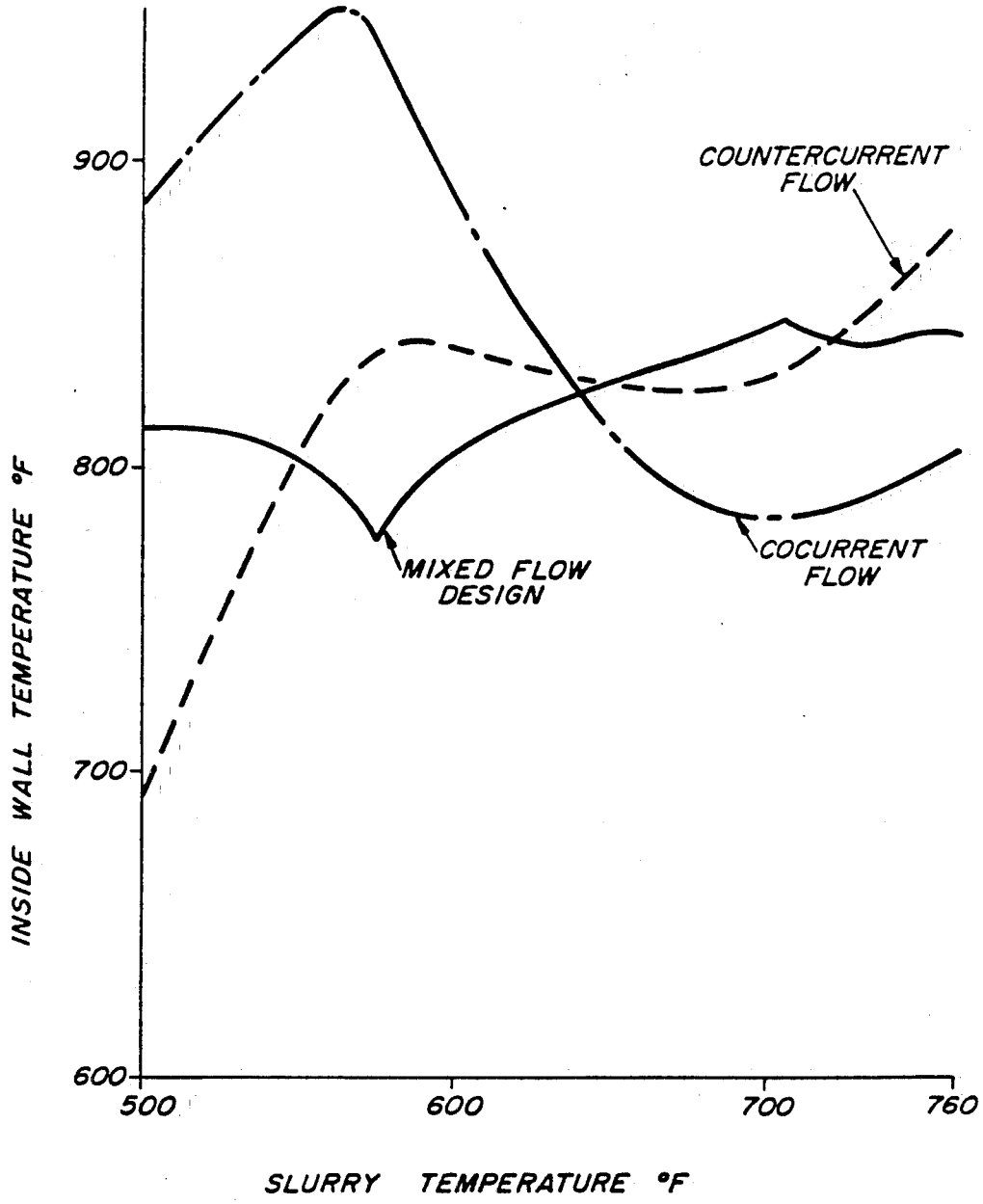
FIG. 14 is a graph showing the relationship between the tube wall temperatures and the slurry temperature for fired heaters with cocurrent flow and countercurrent flow in comparison with the mixed flow arrangement in accordance with the invention.

The calculated tube wall temperature is shown again in FIG. 14 for comparison with wall temperatures which would occur if the heater were designed for co-current or counter-current flow of flue gases and coal slurry. The important improvement is the increased uniformity of the wall temperature throughout the heater. At temperatures above 850° F., the rate of coke formation increases rapidly and thus the co-current or counter-current heater will require more frequent shutdown for decoking than a mixed flow heater in accordance with the present invention. Alternatively, the co-current or counter-current heaters will require more heat transfer surface area in order to limit the coking potential to be equal to the present invention.

It is to be understood that variations may be made in the above-described preferred embodiments without departing from the scope of the invention as defined by the following claims.

What is claimed is:

1. A convective heater downstream of a radiant burner for heating fluids such as a slurry or the like comprising:

(a) means defining an elongated heating chamber having an inlet at one end and an outlet at its other end, imperforate means dividing said elongated chamber along its length and extending the total length of said chamber into two parallel heating gas flow paths, each of said flow paths being in the same direction wherein the heated gases passing from said inlet to said outlet are divided into two heating gas streams passing upwardly in the same direction;

(b) conduit means for passing said fluid to be heated in a continuous series flow through said heating chamber in heat exchange relationship with the heating gases passing from said inlet to said outlet;

(c) said conduit means being constructed and arranged to provide a continuous series mixed flow tube circuit in which the fluid to be heated enters one of said heating gas flow paths at a location between said inlet and said outlet to flow in a co-current direction with said heating gases through said one path to a location near said outlet whereat said tube circuit transfers in series flow to said other heating gas path to then flow in a counter-current direction relative to said heating gas through said other path to a location near said inlet whereat said tube circuit transfers in series flow back to said one path to flow in a co-current direction to said entry location whereat said tube circuit leaves said one path, and wherein said tube circuit comprises tubes arranged in a serpentine-like arrangement passing back and forth transversely through said heating chamber as the fluid to be heated flows in said co-current and counter-current flow paths, said serpentine arrangement of tubes comprising return bends located externally of said heating chamber, said tube circuit comprising a plurality of parallel stacks of tubes in each of said paths.

2. A convective heater according to claim 1 wherein said conduit comprises three parallel mixed flow tube circuits.

3. A convective heater according to claim 2 wherein each of said tube circuits comprises tubes arranged in a serpentine-like arrangement passing back and forth transversely through said heating chamber as said coal slurry to be heated flows in said co-current and counter-current flow paths.

4. A convective heater according to claim 3 wherein said serpentine arrangement of tubes comprises return bends located externally of said heating chamber.

5. A convective heater according to claim 4 wherein said tube circuits comprise three parallel tube stacks in each of said paths, said return bends being arranged to cross back and forth between said stacks so that each tube circuit comprises portions of at least two of said tube stacks.

6. A convective heater according to claim 1 comprising means for regulating the flow through each of said heating gas flow paths.

7. A convective heater according to claim 1 wherein said dividing means divides said chamber into two equal heating gas flow paths.

8. A convective heater according to claim 7 comprising means for regulating the flow through each of said heating gas flow paths.

9. A convective heater according to claim 1 wherein said return bends are arranged to cross back and forth between said stacks so that each tube circuit comprises portions of at least two of said tube stacks.

* * * * *